US008432104B2

(12) United States Patent
Hu et al.

(10) Patent No.: US 8,432,104 B2
(45) Date of Patent: Apr. 30, 2013

(54) LOAD CURRENT BALANCING CIRCUIT

(75) Inventors: Yuequan Hu, Morrisville, NC (US); Milan Jovanovic, Cary, NC (US)

(73) Assignee: Delta Electronics, Inc., Taipei (TW)

( * ) Notice: Subject to any disclaimer, the term of this patent is extended or adjusted under 35 U.S.C. 154(b) by 329 days.

(21) Appl. No.: 12/964,075

(22) Filed: Dec. 9, 2010

(65) Prior Publication Data

US 2012/0146546 A1 Jun. 14, 2012

(51) Int. Cl.
*H05B 41/16* (2006.01)

(52) U.S. Cl.
USPC ..... 315/282; 315/274; 315/291; 315/312; 315/185 S

(58) Field of Classification Search ..... 315/274–279, 315/282, 291, 307, 312–326, 224, 209 R
See application file for complete search history.

(56) References Cited

U.S. PATENT DOCUMENTS 3,619,655 A 11/1971 Cunningham
4,567,379 A 1/1986 Corey et al.
6,621,235 B2 9/2003 Chang
6,690,146 B2 2/2004 Burgyan et al.
7,294,971 B2 11/2007 Jin
7,358,684 B2 4/2008 Wey et al.
7,408,308 B2 8/2008 Sawada et al.
7,876,055 B2 * 1/2011 Hosaka et al. ..... 315/277
7,880,407 B2 * 2/2011 Fang et al. ..... 315/312
2009/0195169 A1 8/2009 Huang et al.
2010/0237802 A1 * 9/2010 Aso et al. ..... 315/294
2010/0264836 A1 * 10/2010 Godbole ..... 315/185 R

FOREIGN PATENT DOCUMENTS

WO WO-2010/056004 A2 5/2010

* cited by examiner

*Primary Examiner* — Tuyet Thi Vo
(74) *Attorney, Agent, or Firm* — Venable LLP; Robert S. Babayi

(57) ABSTRACT

A load current balancing circuit that operates with a direct current (DC) power supply includes at least one transformer having a first inductive element adapted to couple in series with a first load and a second inductive element adapted to couple in series with a second load. The first load is parallel to the second load. The load balancing circuit further includes at least one switch adapted to operate at one or more switching frequencies associated with at least one driving signal. The switch is configured to periodically interrupt respective current flows through the first inductive element and second inductive element substantially simultaneously.

23 Claims, 14 Drawing Sheets

LOAD CURRENT BALANCING CIRCUIT

FIELD OF THE INVENTION

The present invention generally relates to current balancing of parallel loads and more particularly, to a load current balancing circuit that operates with a direct current (DC) power supply.

BACKGROUND

As a result of continuous technological advances that have brought about remarkable performance improvements, light-emitting diodes (LEDs) are increasingly finding applications in traffic lights, automobiles, general-purpose lighting, and liquid-crystal-display (LCD) backlighting. As solid state light sources, LED lighting is poised to replace existing lighting sources such as incandescent and fluorescent lamps in the future since LEDs do not contain mercury, exhibit superior longevity, and require low maintenance.

A light-emitting diode (LED) is a semiconductor device that emits light when its p-n junction is forward biased. While the color of the emitted light primarily depends on the composition of the material used, its brightness is directly related to the current flowing through the junction. As a result, an effective way to ensure that LEDs produce similar light output is to connect them in series so that all LEDs in the string have the same current. Unfortunately, a major drawback of the series connection of LEDs is the cumulative voltage drop that eventually limits the number of LEDs in a string. This limitation can be overcome by paralleling LEDs or LED strings. However, since the voltage-current characteristic (V-I curve) of individual LEDs differ and because the LED's forward-voltage drop exhibits a negative temperature coefficient, paralleled LED strings may not have the same, or even similar, currents unless a current sharing (balancing) mechanism is provided.

Generally, current balancing of LED strings connected in parallel can be achieved by a number of techniques. FIG. 1 shows a prior art current balancing approach achieved by connecting current-limiting resistors $R_1$ to $R_n$ in series with corresponding LED strings. While this approach offers simplicity and low cost, its performance is very limited. Specifically, the current balancing accuracy of this passive method solely depends on the matching of the LED string voltages and tolerances of the current-limiting resistors. Generally, current balancing performance of this approach is poor since LED string voltages exhibit significant differences primarily due to manufacturing tolerances and temperature variations.

FIG. 2 shows another prior art method of load current balancing with current regulators. In this method, the current in each LED string is independently regulated by a corresponding current regulator. As a result, the current in each string can be set precisely to the desired current. Generally, the current regulators can be linear or switching type. Switching regulators offer better efficiency than linear regulators and can be implemented with a step-up and/or step-down topology, making it possible to drive a variety of LED strings, including those with string voltages higher than the source voltage. One the other hand, linear current regulators are more cost effective than their switching counterparts. The major disadvantage of this approach is its implementation cost is relatively high, especially in applications with a large number of paralleled LED strings, because it requires a current regulator for each string.

FIG. 3 shows another prior art method that provides excellent current balancing with a reduced cost compared with the method in FIG. 2. In the approach, disclosed in U.S. Patent Application No. 2009/0195169 by Chung-Tsai Huang et al, current balancing transformers are employed to equalize the currents of the LED strings. In the three-string implementation of the magnetic balancer, as shown in FIG. 3, two transformers with an equal number of turns of the primary and secondary windings are connected between the output rectifier and the filter capacitor in the three isolated outputs of the converter. The current feedback from one output is used to set and regulate the current of the corresponding LED string. Because of the 1:1 turns ratio of the transformer windings, the current flowing through one winding of the transformer produces substantially the same current flowing through the other winding of the transformer provided that the magnetizing current of the transformer is small compared to the winding current. Therefore, if the current of string $S_3$ is regulated by a feedback control as illustrated in FIG. 3, the current of string $S_2$ will be equal to that of string $S_3$ because the currents flowing through windings $W_3$ and $W_4$ of transformer $TR_2$ will be equal. Because the current of string $S_2$ also flows through winding $W_2$ of transformer $TR_1$, the current flowing through winding $W_1$ of transformer $TR_1$, i.e., the current flowing through string $S_1$, will also be equal to that of strings $S_2$ and $S_3$.

A major deficiency of this cost-effective and high-performance magnetic current balancer is that it needs to be integrated with a switch-mode power supply, i.e., the current balancer cannot be used independently. As a result, this approach lacks the flexibility to operate with an arbitrary DC source, for example, a DC battery. In addition, the integration of the magnetic balancer into a switch-mode power supply increases the complexity and, therefore, the cost of the power supply because it requires a separate output for each string. Requiring separate outputs is especially detrimental in applications with a large number of paralleled LED strings.

Therefore, the need exists for a cost-effective and high-performance current balancer that can operate from any DC source.

SUMMARY

Briefly, according to one embodiment of the present invention, a load current balancing circuit that operates with a direct current (DC) power supply includes at least one transformer having a first inductive element adapted to couple in series with a first load and a second inductive element adapted to couple in series with a second load. The first load is parallel to the second load. The load balancing circuit further includes at least one switch adapted to operate at one or more switching frequencies associated with at least one driving signal. The switch is configured to periodically interrupt respective current flows through the first inductive element and second inductive element substantially simultaneously.

According to some of the more detailed features of the invention, the at least one transformer includes a primary winding that includes the first inductive element and a secondary winding that includes the second inductive element. The at least one transformer is a unity turns ratio transformer. The at least one transformer may also be a plurality of transformers each having a primary and a secondary winding, and the primary winding of one transformer is coupled in series with the secondary winding of another second transformer. According to another embodiment, the primary windings of the plurality of transformers are coupled in series. The first inductive element can include the primary windings of the plurality of transformers. The primary windings can also be coupled in series and shorted.

According to other more detailed features of the invention, the load current balancing circuit further includes a current limiting circuit. The current limiting circuit may include a resistor. A voltage across the current limiting circuit may be sensed and used to adjust the output voltage of the DC power supply to minimize power loss. In one embodiment, the load current balancing circuit further includes a detector that opens the at least one switch upon detecting a load fault.

According to further more detailed features of the invention, the at least one driving signal includes a higher frequency signal modulated by a lower frequency signal. The first load and second load include light-emitting diodes (LED), wherein the lower frequency signal is a dimming signal. The currents through the first load and second load are adjusted based on at least one of adjusting the duty cycle of the higher frequency signal, adjusting the duty cycle of the lower frequency signal, or adjusting the output of the power supply. Further, the at least one switch may be a plurality of switches, wherein each of the switches are controlled based on a corresponding driving signal. The corresponding driving signals of the plurality of switches may also be phase shifted.

According to additional more detailed features of the invention, the load current balancing circuit further includes a first capacitor connected in parallel with the first load and a second capacitor connected in parallel with the second load, to provide current to the loads when the at least one switch is opened. In another embodiment, the load balancing circuit further includes a first inductor connected in series with the first load and a second inductor connected in series with the second load, to provide current to the loads when the at least one switch is opened. The first inductor and second inductor may be magnetically coupled. In other aspects, the DC power supply may also comprise voltage from at least one of: a battery, a DC/DC converter, or an AC/DC converter. The at least one switch may also be a plurality of switches each connected in series with a corresponding inductive element and a corresponding load. The plurality of switches maybe switches that are substantially simultaneously opened and closed.

According to another aspect, the load current balancing circuit further includes a first rectifier diode connected in series with the first load and a second rectifier diode connected in series with the second load, to reduce the equivalent capacitances of the first rectifier diode connected to the first load and the second rectifier diode connected to the second load.

DETAILED DESCRIPTION OF THE INVENTION

Figure 1:
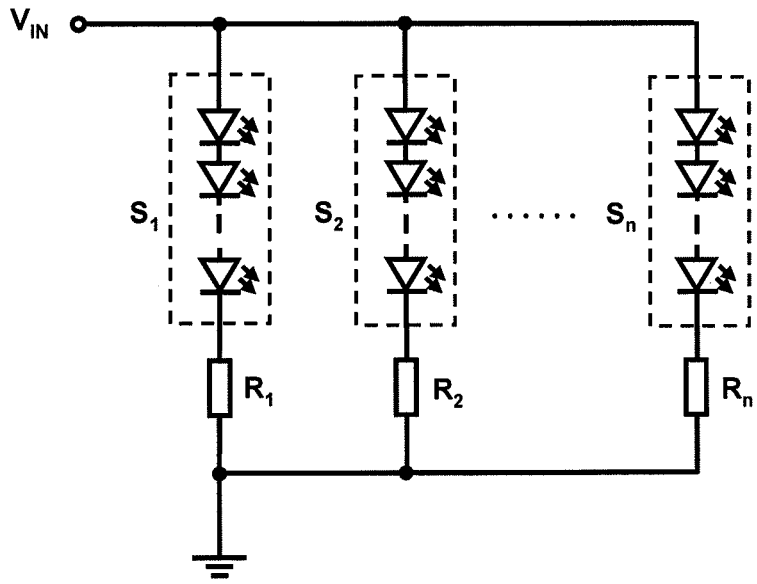
Fig. 1 Prior Art
FIG. 1 shows a block diagram of a prior art method of current balancing paralleled loads with a series resistor for each load.
Figure 2:
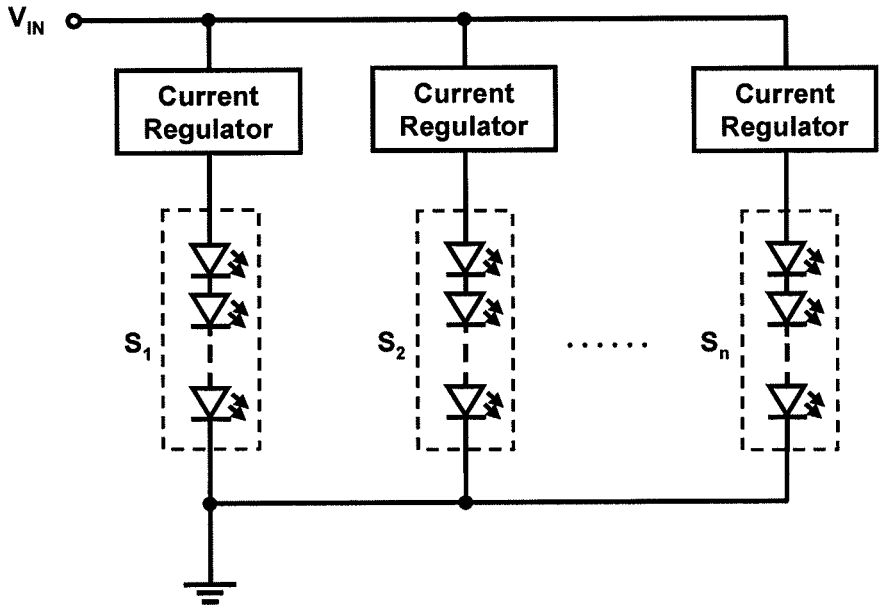
Fig. 2 Prior Art
FIG. 2 shows a block diagram of a prior art method of current balancing paralleled loads with a current regulator for each load.
Figure 3:
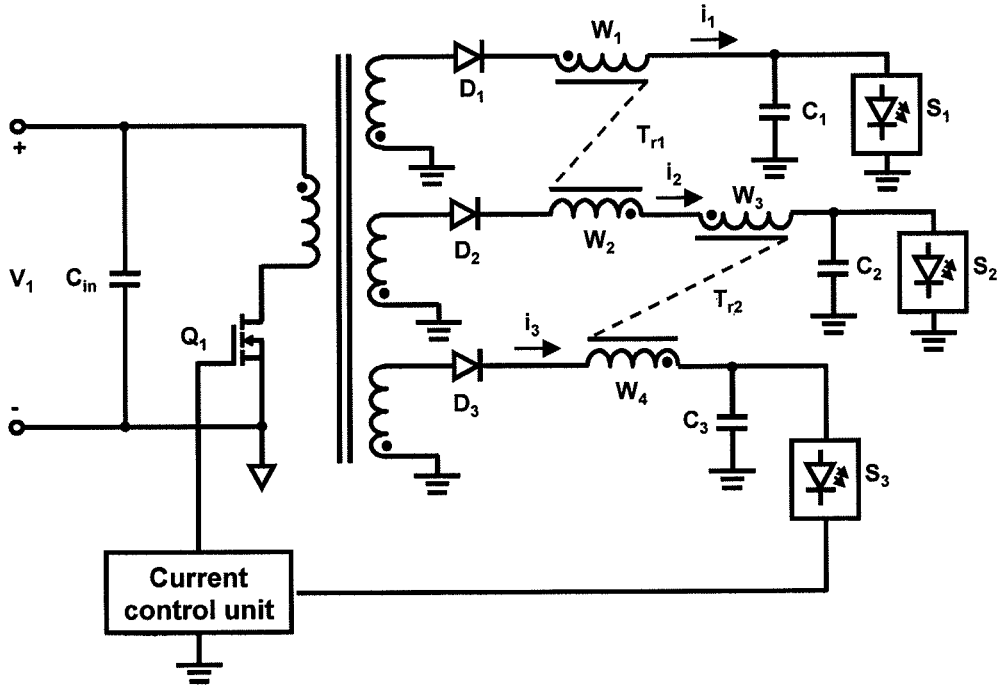
Fig. 3 Prior Art
FIG. 3 shows a block diagram of a prior art method of current balancing paralleled loads with current balancing transformers integrated in a switched mode power supply.
Figure 4:
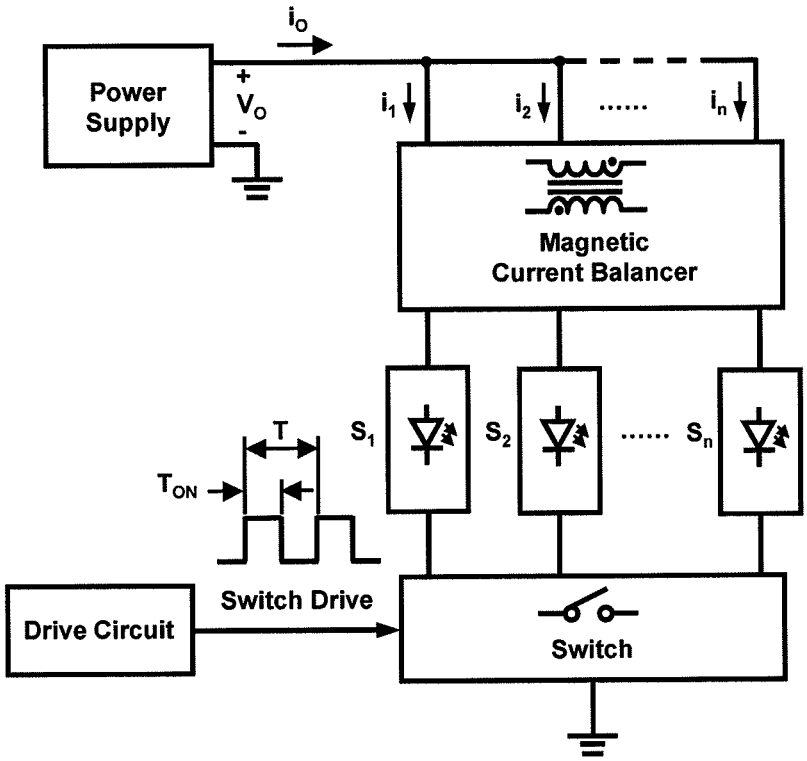
FIG. 4 shows a block diagram of a load current balancing circuit according to an embodiment of the present invention.

The present invention relates to a load current balancing circuit for balancing current flow to parallel loads. FIG. 4 shows a block diagram of a load current balancing circuit according to an embodiment of the present invention. The load balancing circuit operates with a direct current (DC) power supply. The load balancing circuit includes at least one transformer having a first inductive element adapted to couple in series with a first load and a second inductive element adapted to couple in series with a second load, wherein the first load is parallel to the second load. The load balancing circuit further includes at least one switch adapted to operate at one or more switching frequencies associated with at least one driving signal. The switch is configured to periodically interrupt respective current flows through the first inductive element and second inductive element substantially simultaneously. The power supply can be any type of power source, e.g., an alternating current (AC)/DC or a DC/DC converter, or a battery. The loads can be any load on current, e.g., resisters, diodes, light emitting diodes (LEDs), etc.

The block diagram shows a DC power supply providing current $i_O$, at least one transformer comprising the magnetic current balancer, at least one switch coupled to a plurality of parallel-connected loads, LED strings, and a driving circuit for the at least one switch. Each LED string comprises a sequence of a plurality of serially coupled LEDs of the same or different colors such that the anode of one LED in the sequence is coupled to the cathode of another LED in the sequence. Each LED string has a cumulative forward voltage that is the sum of the forward voltage of the one or more LEDs. The transformers are used to balance the current flowing through each LED string.

The switch, which is periodically turned on and off by a signal from the driving circuit, plays two roles. One role is to provide a flux-reset mechanism for the current-balancing transformers, i.e., to enable operation of the transformer with a DC power source. Namely, during the turn-on time of the switch, the current flows through the string(s) connected to the switch, whereas during the turn-off time of the switch, the current through the string(s) is zero and the magnetic core of the transformer is reset. Because of the switching, the average current through the $k^{th}$ LED string is $I_{AVE(k)}=i_k D$, where $i_k$ is the current amplitude of $k^{th}$ LED string (k=1, 2, . . . , n), and $D=T_{ON}/T$ is the duty cycle, $T_{ON}$ is the turn-on time of switches, and T is the switching period of the switch, respectively. Since the brightness of the LEDs is directly related to the average driving current, the brightness of the LEDs can be varied by varying duty cycle D. Therefore, another function of the switch is to provide pulse-width-modulated (PWM) dimming.

However, dimming can also be provided by changing voltage/current of the power supply, without the need for PWM control of the switch in the load current balancing circuit. Moreover, the dimming implemented by changing voltage/current of the power supply can be done either by PWM dimming or analog dimming techniques. If the switch is not used for dimming, its duty may be maximized to provide the maximum possible brightness. Generally, the maximum duty cycle of the switch is dependent on the switching speed of LED strings and switching frequency. In applications with strings that have a fewer number of LEDs, higher duty cycles can be achieved by operating the control switch at lower frequencies.

Figure 5:
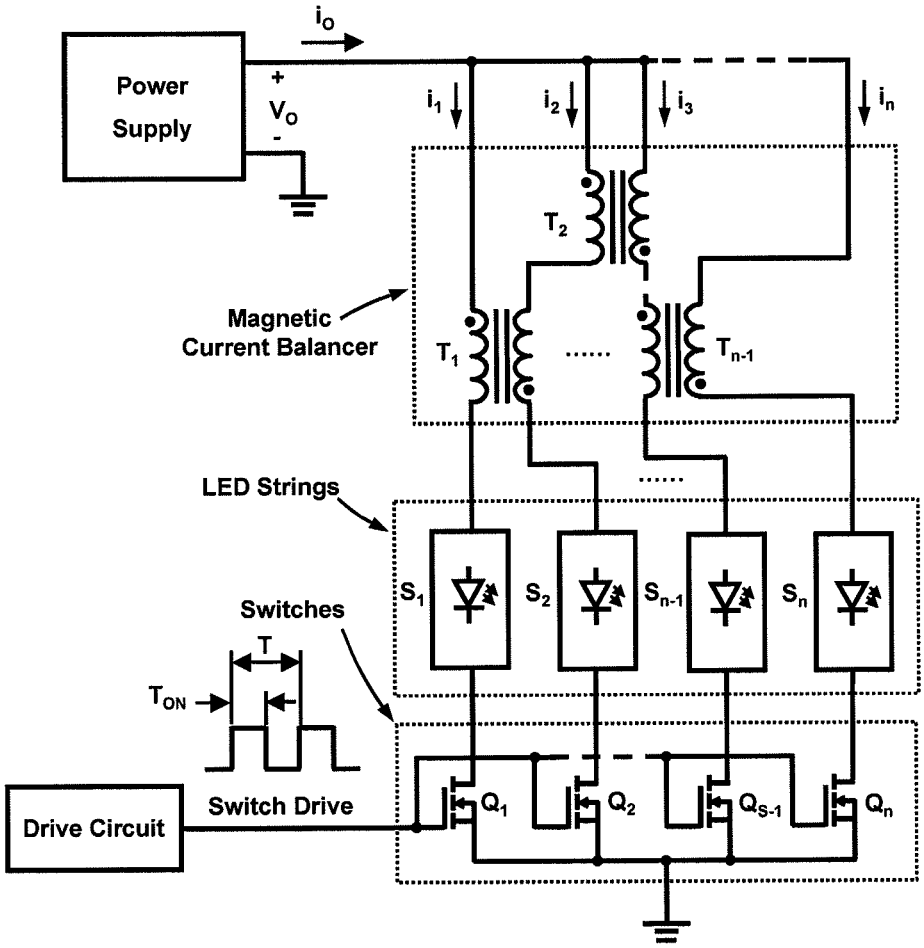
FIG. 5 shows a block diagram of a load current balancing circuit with multiple switches according to an embodiment of the present invention.

FIG. 5 shows a block diagram of a load current balancing circuit with multiple switches according to an embodiment of the present invention. The LED driver comprises a power supply providing a constant current $i_O$, a magnetic current balancer consisting of transformers $T_1$-$T_{n-1}$, and switches $Q_1$-$Q_n$ with associated drive circuit. As can be seen in FIG. 5, each transformer has a primary winding and a secondary winding. The primary winding includes a first inductive element and a secondary winding includes the second inductive element. In FIG. 5, the transformers are unity turns ratio transformers where the primary windings and secondary windings have equal number of turns.

The transformer winding polarities are arranged so that the current in an LED string flows into the "dot" terminal of the primary winding of a transformer, whereas the current in an adjacent LED string flows out of the "dot" terminal of the secondary winding of the same transformer. Switches $Q_1$ to $Q_n$, which are series-connected to a respective LED string, are periodically turned on or off by a drive signal. As shown, in FIG. 5, the plurality of switches are each connected in series with a corresponding inductive element and a corresponding load. Additionally, as the switches are connected to the same driving signal, they are also substantially simultaneously opened and closed. The switches can be any type of switches that are responsive to the drive signal. In FIG. 5, n-type MOSFETs (metal-oxide-semiconductor field-effect transistors) are shown.

Because transformers $T_1$-$T_n$ have unity turns ratio, their primary and secondary currents are substantially equal if the magnetizing current of the transformers is much smaller than the winding current. Therefore, assuming that the magnetizing current is small enough that it can be neglected, current flowing through string $S_1$ is equal to current $i_2$ flowing through string $S_2$ since current $i_1$ is the primary current of transformer $T_1$, whereas current $i_2$ is the secondary current of transformer $T_1$.

Further, as seen in the path for string $S_2$ the primary winding of one transformer, $T_2$ is coupled in series with the secondary winding of another second transformer, $T_1$. Because the primary of transformer $T_2$ is connected in series with the secondary of transformer $T_1$, current $i_2$ is also the primary current of transformer $T_2$. Accordingly, current $i_3$ flowing through string $S_3$, which is the secondary current of transformer $T_2$, is equal to current $i_2$. Therefore, the currents through strings $S_1$-$S_3$ are equal, i.e., $i_1=i_2=i_3$. Carrying out the same argument to the rest of the strings, the string currents for all the strings are equal, i.e., $i_1=i_2=i_3= \ldots =i_n$, regardless of values of LED-string voltages.

Figure 6:
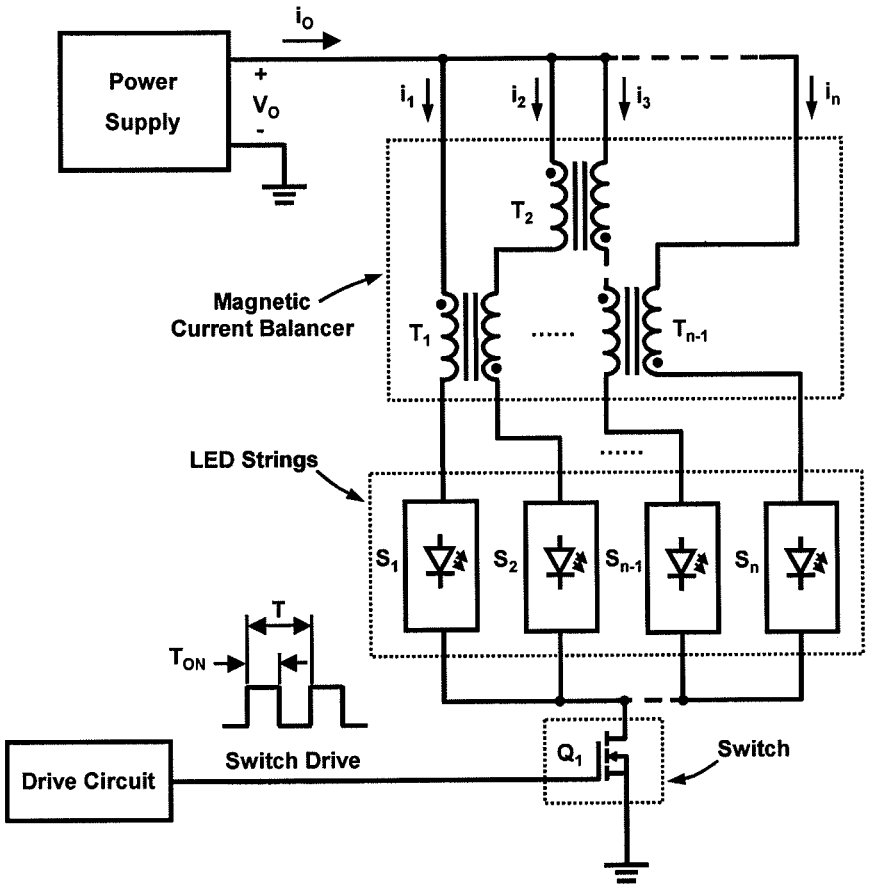
FIG. 6 shows a block diagram of a load current balancing circuit with a single switch according to an embodiment of present invention.

FIG. 6 shows a block diagram of a load current balancing circuit with a single switch according to an embodiment of present invention. In order to reduce the number of switches, single switch $Q_1$ can be used. The operation of the circuit in FIG. 6 is identical to that in FIG. 5. To reduce the number of figures, in the following descriptions only implementations with single switch are shown, unless the embodiment is best shown with multiple switches.

Figure 7:
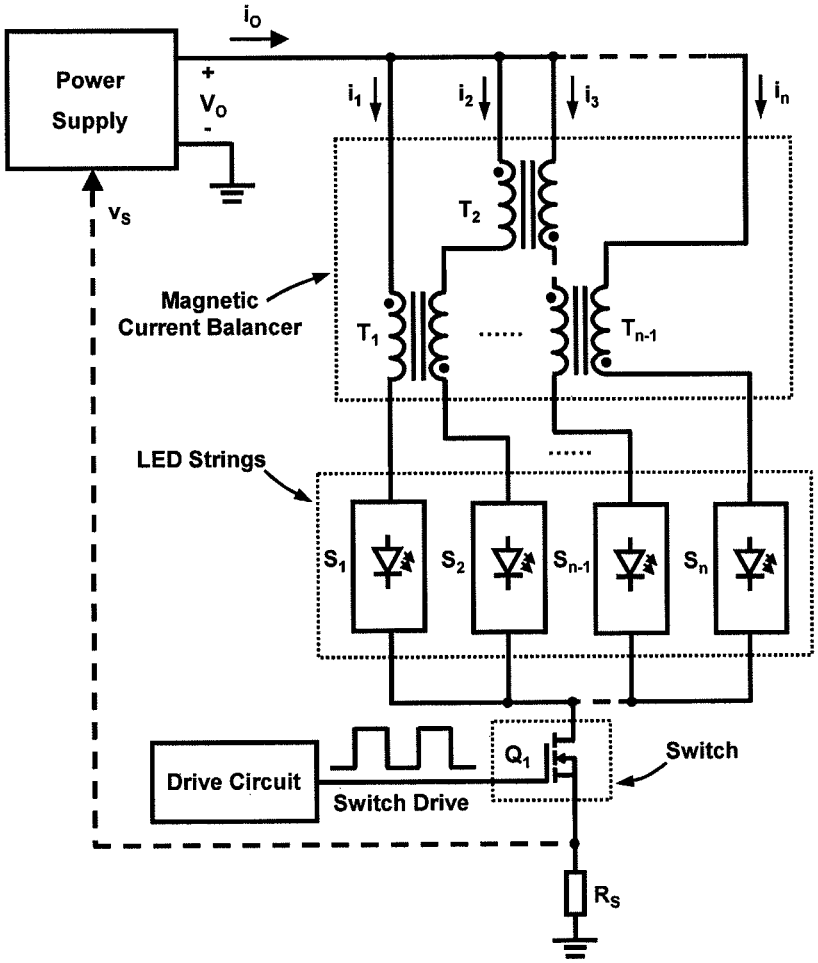
FIG. 7 shows a block diagram of a load current balancing circuit with a current limiting circuit according to an embodiment of present invention.

FIG. 7 shows a block diagram of a load current balancing circuit with a current limiting circuit according to an embodiment of present invention. The current-balancing method can also be applied to loads supplied by a voltage source, i.e., a power supply whose output current is not internally regulated or set to a desired level. In this embodiment, the current of the paralleled strings is set by a current limiting circuit. Here, the current limiting circuit is resistor $R_s$ in series with switch $Q_1$. For a given supply voltage $V_O$, the value of $R_s$ is selected so that the total current of LED strings $S_1$-$S_n$ is set to the desired level. In another embodiment, power dissipation of resistor $R_s$ can also be minimized by adjusting the current via a current feedback. As shown by the dashed line in FIG. 7, a voltage across the current limiting circuit is sensed and used to adjust the output voltage of the DC power supply to minimize power loss. Specifically, the voltage across $R_s$ is sensed and the supply voltage $V_O$ changed to get the desired current. The addition of resistor $R_s$ has no effect on the operation of the current sharing circuit. Therefore, to reduce the number of figures, the following descriptions will be given for one implementation knowing that the same considerations apply to other implementations.

Figure 8:
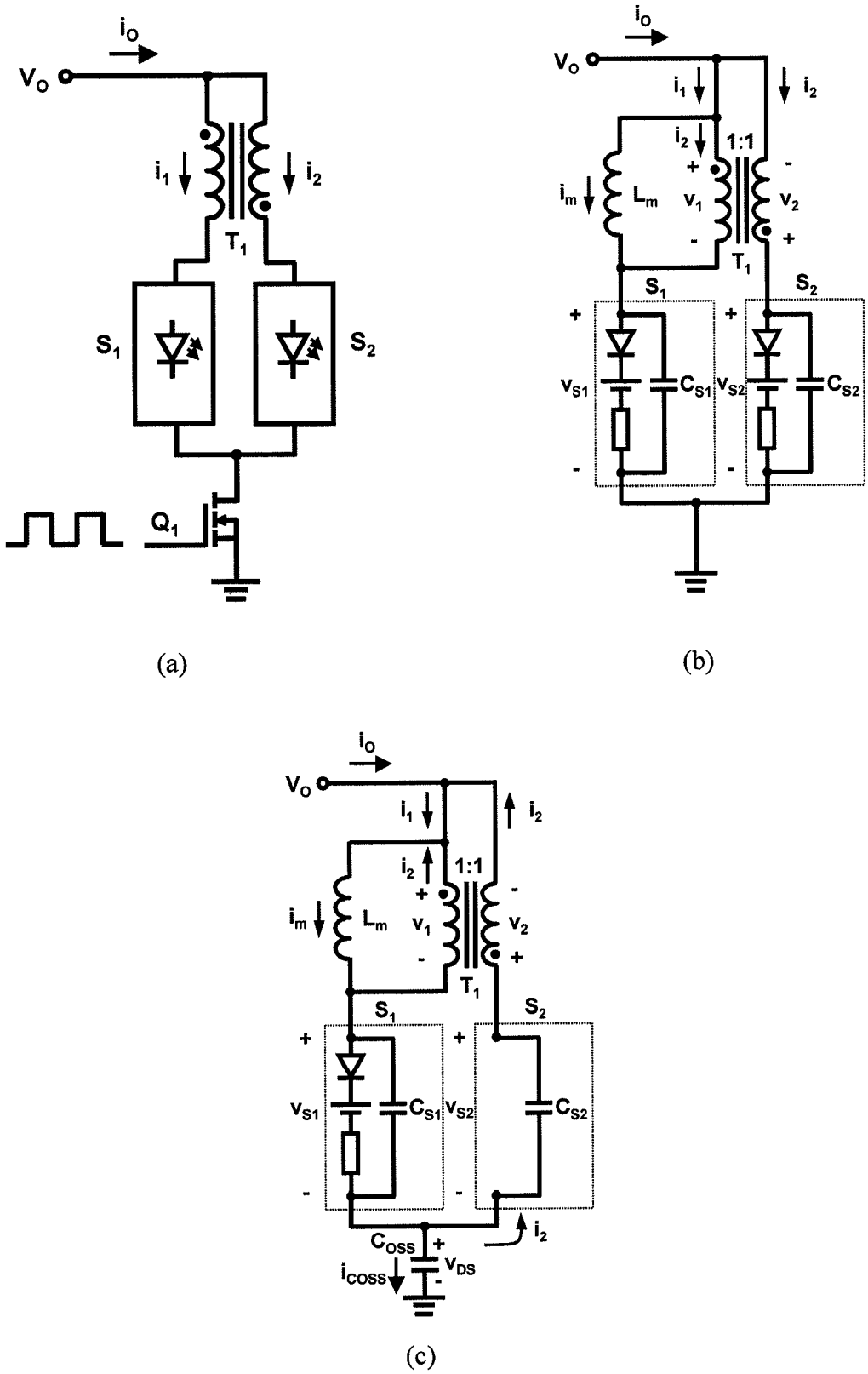
FIG. 8 shows block diagrams of load current balancing circuit as a simplified circuit and in operation according to an embodiment of present invention.

FIG. 8 shows block diagrams of load current balancing circuit as a simplified circuit and in operation according to an embodiment of present invention. The magnetizing current of the transformers has a paramount effect on the current balancing (sharing) performance. To facilitate the understanding of the operation of the load current balancing circuit and the evaluation of its current-balancing performance, a simple load current balancing circuit of FIG. 8 with two paralleled LED strings is analyzed. In this analysis, each LED string is modeled by a series connection of an ideal diode which has zero forward voltage drop, equivalent DC voltage source $V_S$ (equal to the turn-on threshold), and an equivalent series resistance, as well as total string capacitance $C_S$ connected in parallel. When switch $Q_1$ is turned on, as shown in FIG. 8 (*b*), currents $i_1$ and $i_2$ flow through strings $S_1$ and $S_2$, respectively, and $$v_1+v_{S1}=V_O, \quad (1)$$

$$-v_2+v_{S2}=V_O, \quad (2)$$

$$i_1=i_2+i_m, \quad (3)$$

where $v_{S1}$ and $v_{S2}$ are the voltages across the first and second strings, respectively.

Since $v_1=v_2$ because of the unity turns ratio of the current-balancing transformer, from (1) and (2), $$v_1=v_2=(v_{S2}-v_{S1})/2, \quad (4)$$

the voltage across the current-balancing transformer windings is the average of the string-voltage mismatching.

As can be seen from (3), the mismatching of string currents is equal to magnetizing current $i_m$. Assuming that $v_{S2}>v_{S1}$, the increase of magnetizing current $i_m$ during the turn-on time of switch $Q_1$ is a function of voltage $v_1$, duty cycle D, switching period T, and magnetizing inductance $L_m$, i.e., $$\Delta i_m=v_1DT/L_m. \quad (5)$$

When switch $Q_1$ is turned off, the magnetizing current continues to flow and drain-to-source capacitor $C_{OSS}$ of the switch is charged by current $i_{COSS}$, as shown in FIG. 8 (*c*), causing string voltages $v_{S1}$ and $v_{S2}$ to decrease. Eventually, the string with a higher forward voltage, e.g., string $S_2$, is turned off, and its stray capacitor $C_{S2}$ is discharged by current $i_2$. However, string $S_1$ that has a lower forward voltage stays on as long as magnetizing current $i_m$ in FIG. 8 (*c*) is larger than current $i_2$. In fact, the magnetizing current continues to increase until string voltage $v_{S2}$ becomes equal to string voltage $v_{S1}$. After this moment, the transformer core starts to reset, i.e., magnetizing current $i_m$ starts decreasing, since $v_{S1}>v_{S2}$ and a negative voltage is applied across the magnetizing inductance $L_m$. From FIG. 8 (*c*), during the switch-off time, $$i_m=i_1+i_2=(i_{COSS}+i_2)+i_2=i_{COSS}+2i_2=C_{OSS}dv_{DS}/dt+2C_{S2}|dv_{S2}/dt|. \quad (6)$$

From (5) an (6), it can be seen that the magnetizing current during switch-on time is a function of string-voltage mismatching $v_1$, duty cycle D, switching period T, magnetizing inductance $L_m$, and currents $i_2$ and $i_{COSS}$. In order to minimize the difference between string currents $i_1$ and $i_2$, current $i_m$ should be as small as possible.

Figure 9:
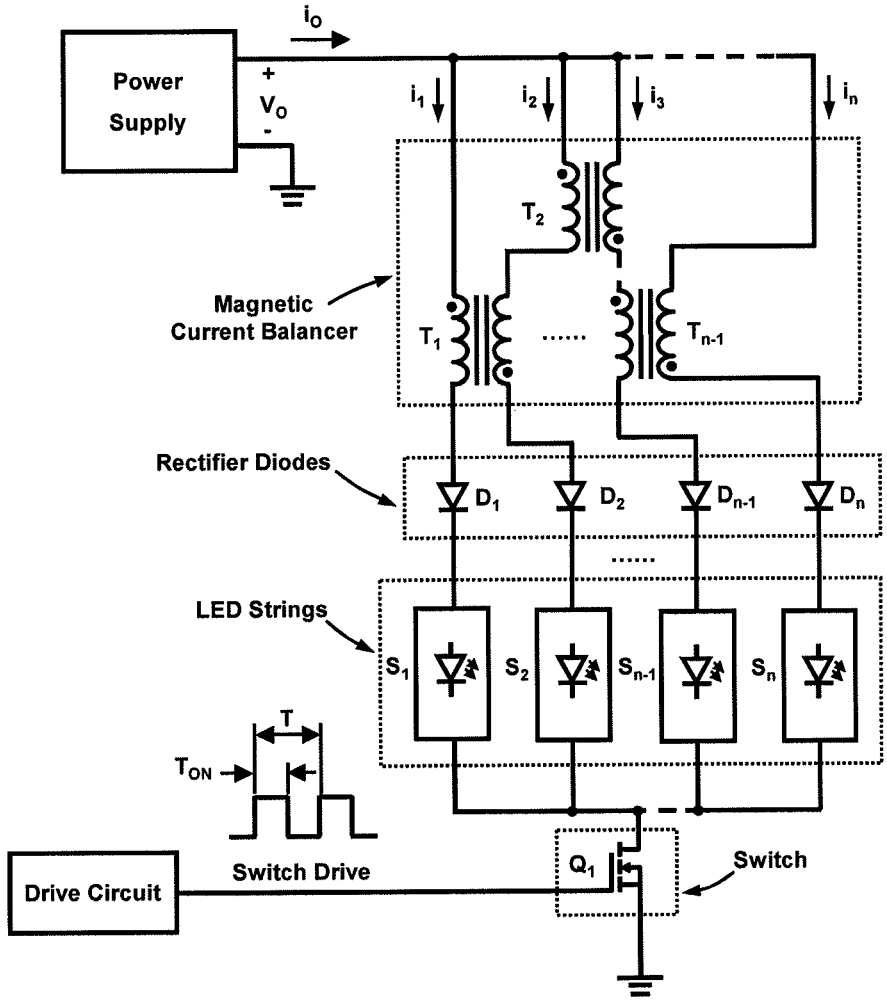
FIG. 9 shows a block diagram of a load current balancing circuit with rectifier diodes to reduce equivalent capacitance according to an embodiment of present invention.

FIG. 9 shows a block diagram of a load current balancing circuit with rectifier diodes to reduce equivalent capacitance according to an embodiment of present invention. For a given mismatching of string voltages, switching frequency and magnetizing inductance, the current-sharing performance is strongly dependent on duty cycle D of switch $Q_1$, parasitic capacitances $C_{S1}$ and $C_{S2}$ of the LED strings, and drain-to-source capacitance $C_{OSS}$ of switch $Q_1$. In fact, to maintain the volt-second balance of the transformer, as duty cycle D increases and the reset time for the magnetic core decreases, the slope of voltage $v_1$ during turn-off time of switch $Q_1$ must increase, resulting in a larger slope (dv/dt) of voltages $v_{DS}$ and $v_{S2}$. Therefore, both current $i_{COSS}=C_{OSS}dv_{DS}/dt$ and $i_2=C_{S2}|dv_{S2}/dt|$ increase, leading to the increase of magnetizing current $i_m=i_{COSS}+2i_2$.

In order to reduce $i_m$, capacitance $C_{OSS}$ and LED-string capacitances can be minimized. Generally, the LED-string capacitance becomes progressively smaller as the number of LEDs in a string increases because the capacitances of individual LEDs are connected in series. In strings with a small number of LEDs, the equivalent string capacitance can be reduced by adding a low-capacitance rectifier diode (not an LED) in series with the LED string. As shown in FIG. 9, the load current balancing circuit may further include a first rectifier diode connected in series with the first load and a second rectifier diode connected in series with the second load, to reduce the equivalent capacitances of the first rectifier diode connected to the first load and the second rectifier diode connected to the second load.

Figure 10:
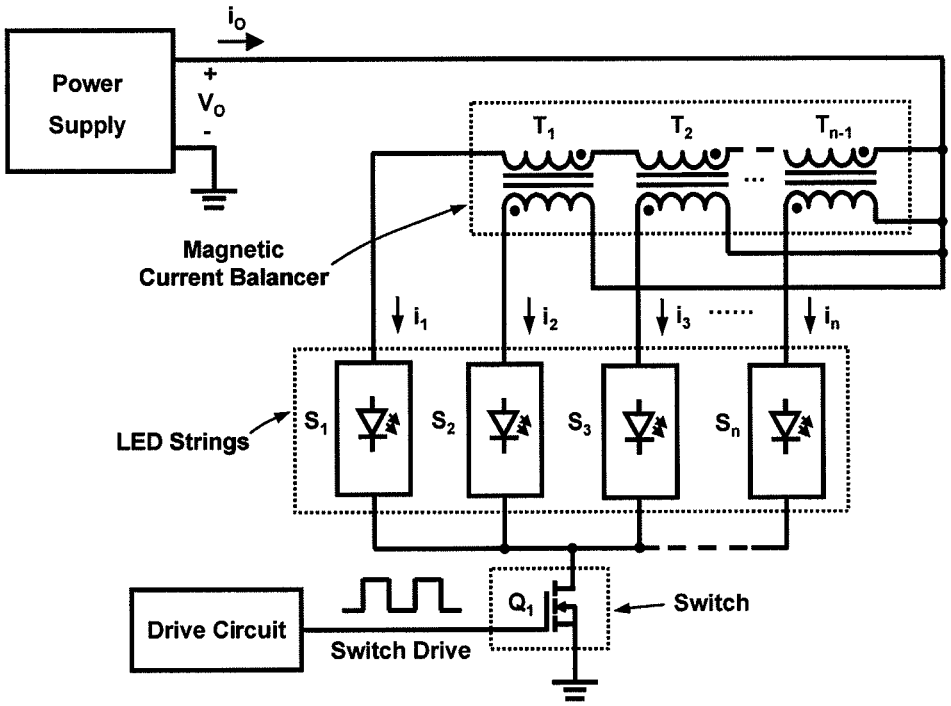
FIG. 10 shows a block diagram of a load current balancing circuit with primary windings connected in series and coupled to one paralleled load according to an embodiment of present invention.

FIG. 10 shows a block diagram of a load current balancing circuit with primary windings connected in series and coupled to one paralleled load according to an embodiment of present invention. The load current balancing circuit includes a plurality of transformers each having a primary and a secondary winding. The primary windings of the plurality of transformers are coupled in series. The first inductive element includes the primary windings of the plurality of transformers. The second inductive element includes a secondary winding of one of the plurality of the transformers. In the block diagram shown in FIG. 10, all primary windings of unity-turns-ratio transformers $T_1$ to $T_{n-1}$ are connected in series and coupled to only one of the paralleled LED strings, string $S_1$, while each secondary winding is coupled in series with a corresponding LED string of the remaining LED strings, strings $S_2$-$S_n$. Because the transformers have the same primary currents, the secondary currents of all transformers are also equal to their primary currents, provided that the magnetizing current of transformers $T_1$ to $T_{n-1}$ is much smaller than the winding currents. Since the current through string $S_1$ is the primary current of the transformers $T_1$-$T_{n-1}$ and the currents through strings $S_2$-$S_1$, are secondary currents of corresponding transformers $T_1$-$T_{n-1}$, all strings carry approximately the same current.

Figure 11:
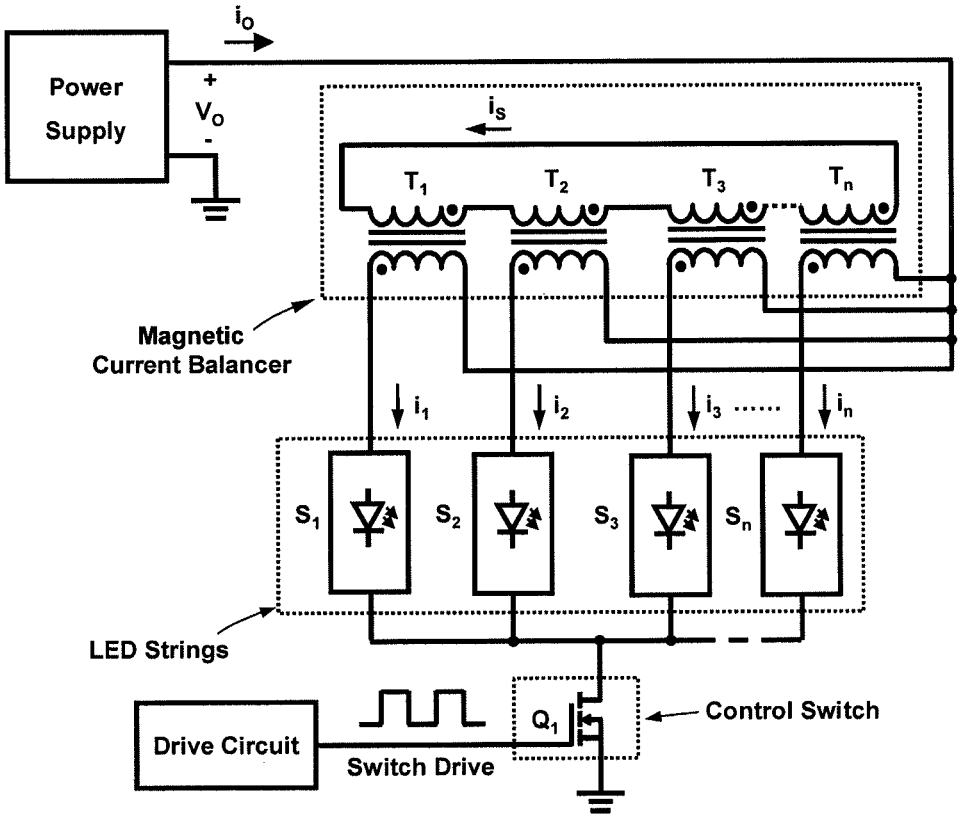
FIG. 11 shows a block diagram of a load current balancing circuit with primary windings connected in series and shorted according to an embodiment of present invention.

FIG. 11 shows a block diagram of a load current balancing circuit with primary windings connected in series and shorted according to an embodiment of present invention. The magnetic current balancer includes n transformers with their primary windings connected in series and shorted and the secondary windings coupled in series with a corresponding LED string. Since the primary currents of the transformers are the same, assuming that the magnetizing current of each transformer is much smaller than the winding current, the secondary currents are also the same. Because the secondary currents are also the string currents, all strings carry approximately the same current. Current balancing is achieved as long as the transformers have the same turns ratio, which does not have to be equal to unity.

Figure 12:
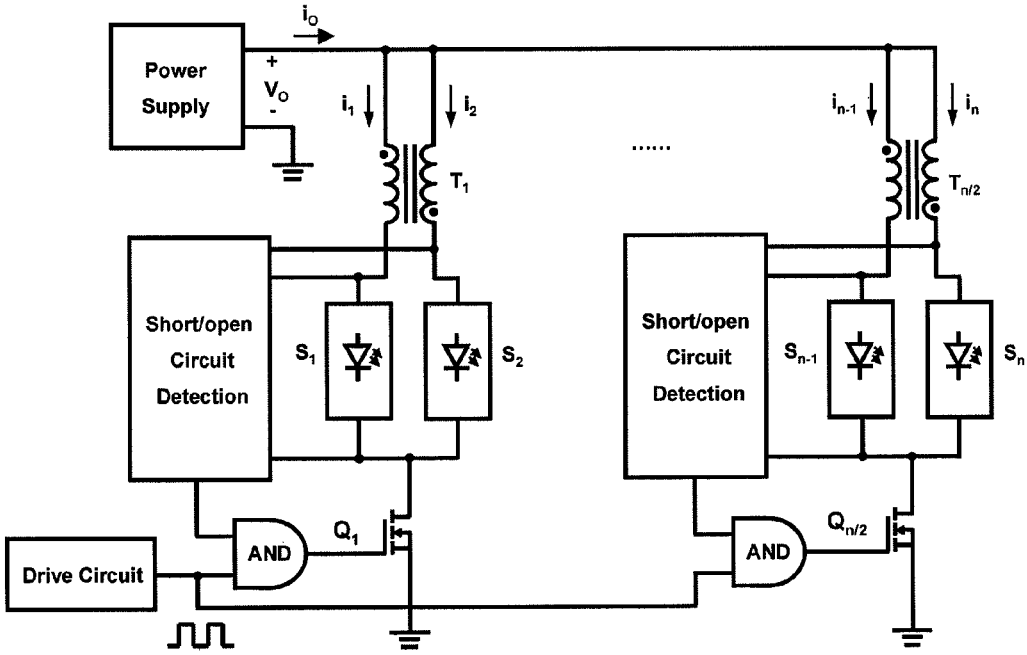
FIG. 12 shows a block diagram of a load current balancing circuit with a detector that opens a switch upon detecting a load fault according to an embodiment of present invention.

FIG. 12 shows a block diagram of a load current balancing circuit with a detector that opens a switch upon detecting a load fault according to an embodiment of present invention In the block diagram, one switch with a corresponding drive signal is employed for each group of two LED strings. However, one switch can be used to drive a group consisting of any number of LED strings. While the grouping of LED strings requires more switches and corresponding drive circuits, grouping enables the operation of LED-string arrays even when one or more strings are open or shorted. For example, in an implementation with a single switch, as shown in FIG. 6, if one LED string is shorted due to a failure, the switch needs to be turned off. Thus, the entire LED-string array will be turned off. Similarly, if one LED string is open, e.g., either because of a failure or simply because it is not installed, the entire LED-string array will not operate with desired brightness because a large magnetizing inductance of the transformer will limit the current to a small value even if the switch continues to be operated.

In the embodiment in FIG. 12, the short circuit of a string can be detected and the shorted string can be isolated from the rest of the circuit by turning off the corresponding switch, allowing uninterrupted operation of the other strings. Similarly, an open string will not have any effect on the remaining pairs of the strings. It should be noted that the open-string condition does not necessarily need to be detected and the corresponding string switch does not need to be turned off since this condition is not harmful. However, during the operation with shorted and/or open LED string(s), the string array generally does not deliver the full light power. In fact, there is a strong trade-off between the robustness of the load current balancing circuit with, i.e., ability to continue to deliver light output in the presence of failures and abnormal conditions, and the cost associated with additional components, e.g., switches and drives. Another disadvantage of grouping LED strings is that although the currents of the LED strings within a group are equal, currents between groups of LED strings are not ensured to be equal.

Figure 13:
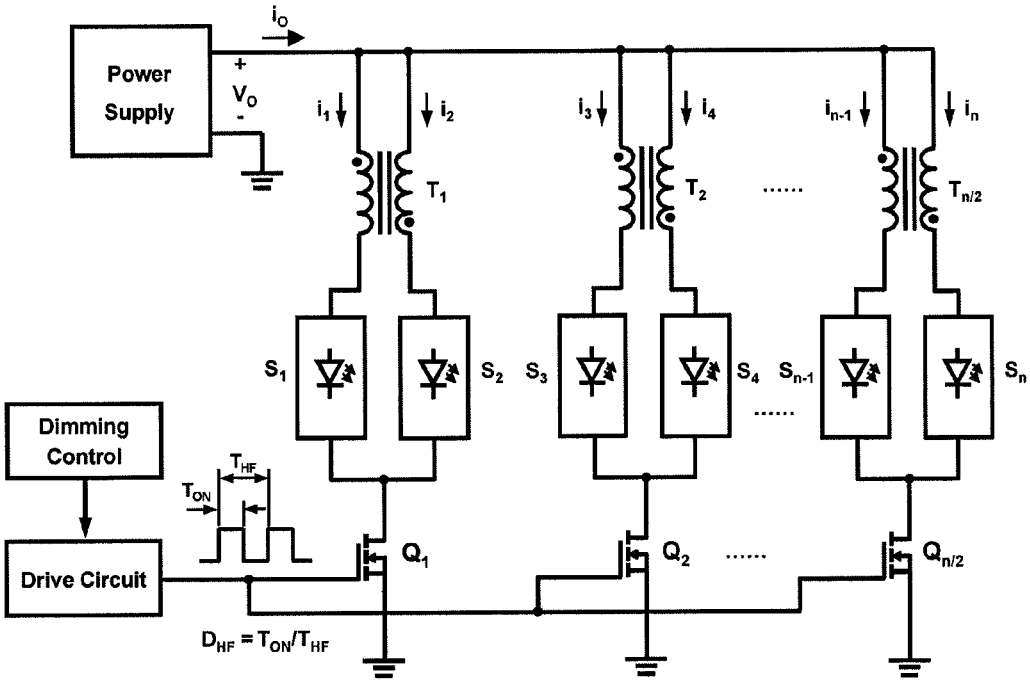
FIG. 13 shows a block diagram of a load current balancing circuit with a dimming circuit controlling a drive circuit for high frequency dimming according to an embodiment of present invention.

FIG. 13 shows a block diagram of a load current balancing circuit with a dimming circuit controlling a drive circuit for high frequency dimming according to an embodiment of present invention Although a primary function of the switch(es) in series with LED strings is to provide the reset of the magnetic cores of current-balancing transformers, the switch(es) can also be used to provide dimming. Because the light intensity of LEDs is proportional to the average current, the light intensity can be controlled by changing the duty-cycle of the switch with a dimming signal coupled to the switch drive circuit. One example using high-frequency pulse width modulated (PWM) dimming can be achieved by changing the duty cycle of a constant-frequency drive signal, or by varying drive-signal frequency, or by a combination of these two methods. In constant-frequency dimming, the light intensity decreases as the duty cycle of the drive signal decreases. In the variable-frequency PWM dimming, the light intensity decreases as the dimming frequency decreases for a constant on-time implementation and the light intensity increases as the dimming frequency decreases for a constant off-time implementation.

Figure 14:
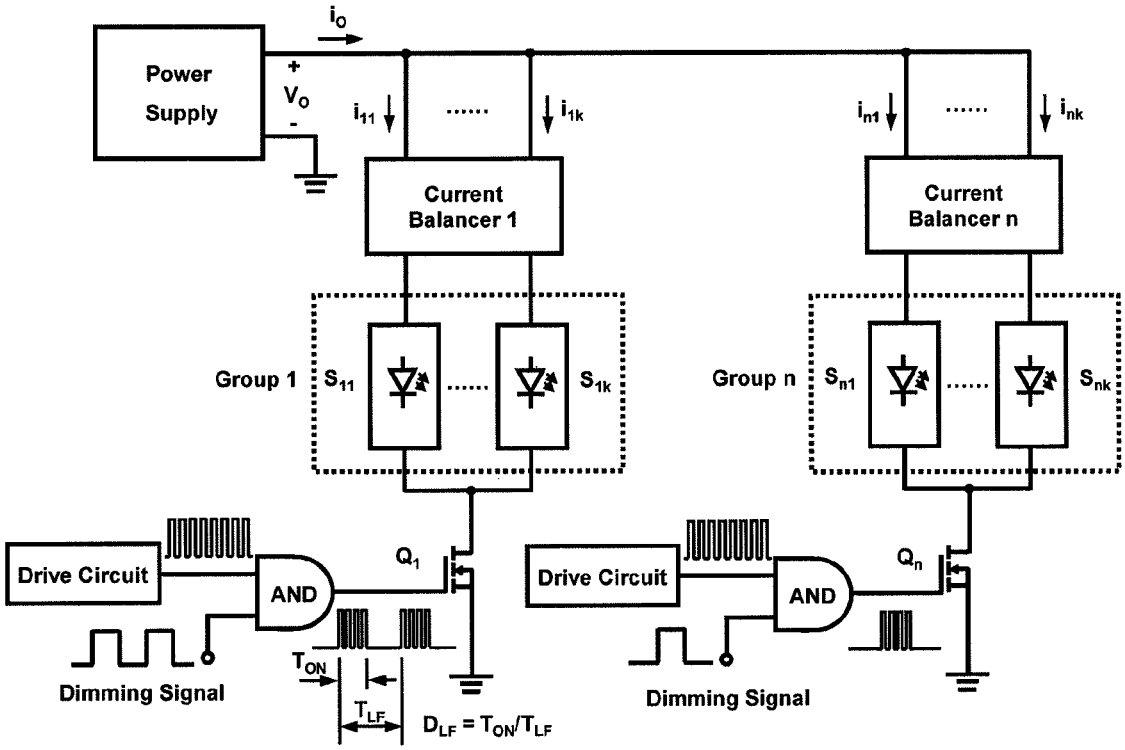
FIG. 14 shows a block diagram of a load current balancing circuit with a low frequency dimming signal modulating a high frequency driving signal for low frequency dimming according to an embodiment of present invention.

The signal that drives the switch of the load current balancing circuit can be a signal with one single frequency or a signal with dual frequencies. FIG. 14 shows a block diagram of a load current balancing circuit with a low frequency dimming signal modulating a high frequency driving signal for low frequency dimming according to an embodiment of present invention. In this dimming approach, a low-frequency signal (typically in the 200-500 Hz range) is used for dimming. The switches ultimately operate on a modulated signal obtained by combining a high-frequency drive signal of the switch(es) having a duty cycle $D_{HF}$ and a low-frequency dimming signal having a duty cycle $D_{LF}$ through the "AND" logic circuit. By varying the combined duty cycle $D_{HF}D_{LF}$ of the switch by varying $D_{LF}$, the average current and, therefore, the brightness of each LED string can be adjusted. Further, phase shifting of PWM dimming signals for each group of the strings, i.e., each switch, can also be utilized. Phase-shift PWM dimming can minimize the instantaneous power drawn from the power source, resulting in less electro-magnetic interference. Instead of implementing dimming within the current-balancing circuit, dimming can also be implemented in the power supply by varying the power supply's regulated output current or voltage.

Figure 15:
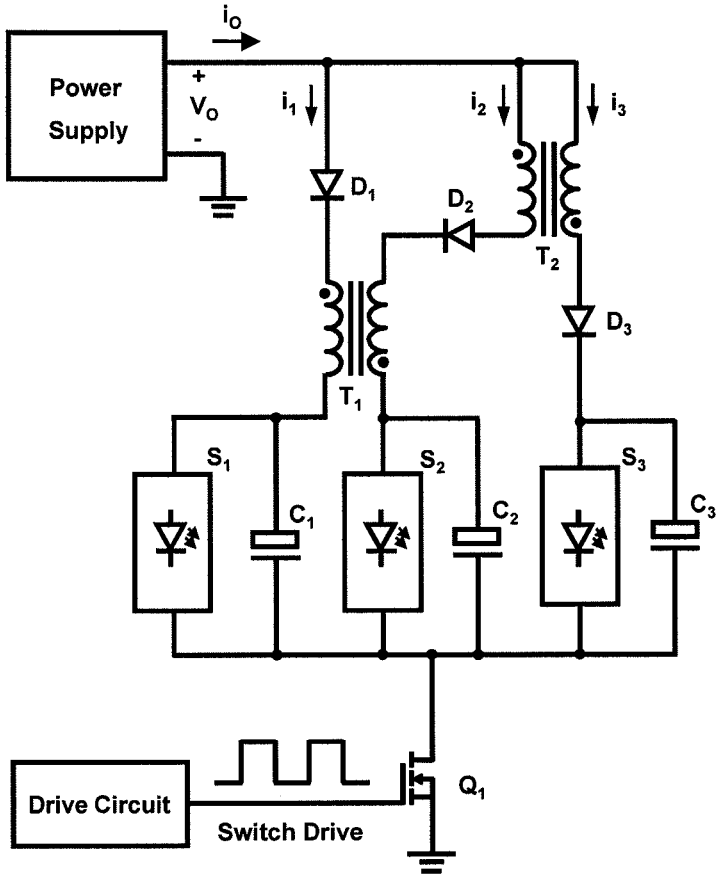
FIG. 15 shows a block diagram of a load current balancing circuit providing continuous current flow with energy-storage capacitors to loads according to an embodiment of present invention.

FIG. 15 shows a block diagram of a load current balancing circuit providing continuous current flow with energy-storage capacitors to loads according to an embodiment of present invention. The load current balancing circuit further includes a first capacitor connected in parallel with the first load and a second capacitor connected in parallel with the second load, to provide current to the loads when the at least one switch is opened. As shown in FIG. 15, an energy-storage capacitor ($C_1$-$C_3$) is connected across each of the three LED strings ($S_1$-$S_3$). Because the externally connected energy-storage capacitor make the corresponding LED-string capacitance large, this embodiment also includes a diode ($D_1$ to $D_3$) in series with the respective winding of the current balancing transformers ($T_1$ and $T_2$) to improve current-balancing performance. When control switch $Q_1$ is turned on, equal currents $i_1=i_2=i_3$ flow through the LED strings and, at the same time, energy-storage capacitors $C_1$, $C_2$, and $C_3$ are charged. When control switch $Q_2$ is turned off, the energy-storage capacitors start discharging through the corresponding LED string providing uninterrupted flow of the LED-string currents. Because in this embodiment the current through the LED strings flows continuously, this embodiment may offer the maximum brightness for a given duty-cycle of the switch.

Figure 16:
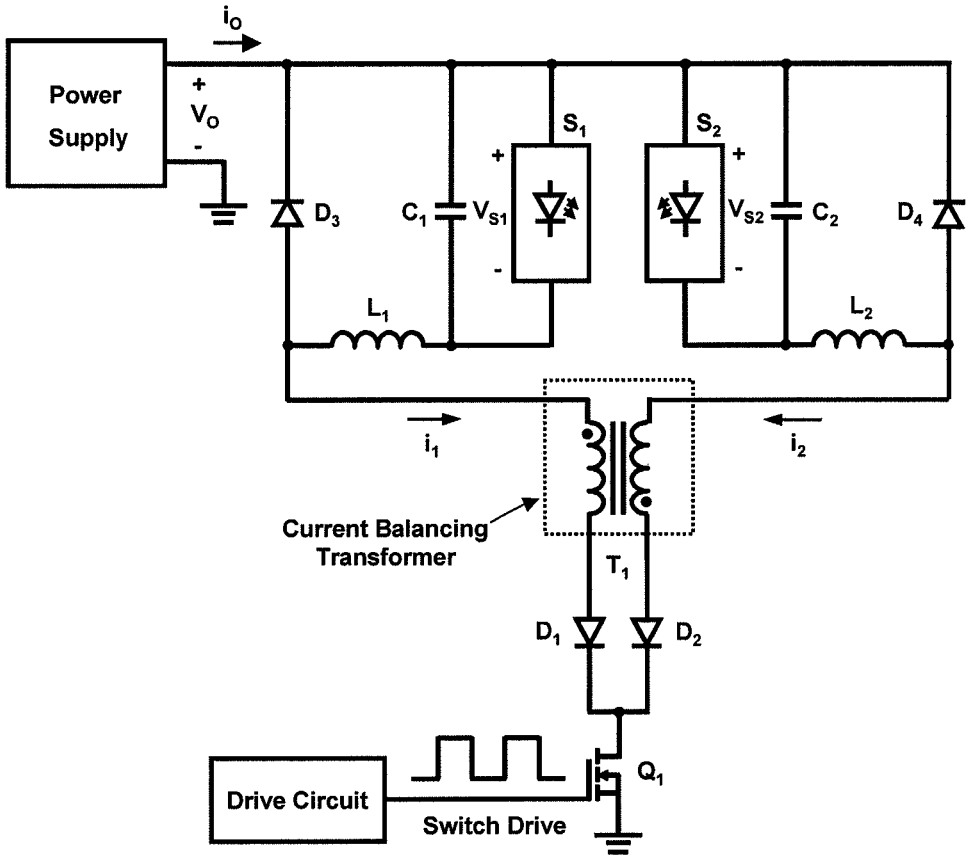
FIG. 16 shows a block diagram of a load current balancing circuit providing continuous current flow with inductors to loads according to an embodiment of present invention.

FIG. 16 shows a block diagram of a load current balancing circuit providing continuous current flow with inductors to loads according to an embodiment of present invention. The load current balancing circuit further includes a first inductor connected in series with the first load and a second inductor connected in series with the second load, to provide current to the loads when the at least one switch is opened. Instead of employing capacitors for energy storage to provide continuous currents for the LED strings, inductors can be used. In this embodiment, capacitors $C_1$ and $C_2$, which are used to filter out the high-frequency current ripple, have a relatively small capacitance, i.e., their capacitance is much smaller than that of the capacitors used in the embodiment in FIG. 15.

Figure 17:
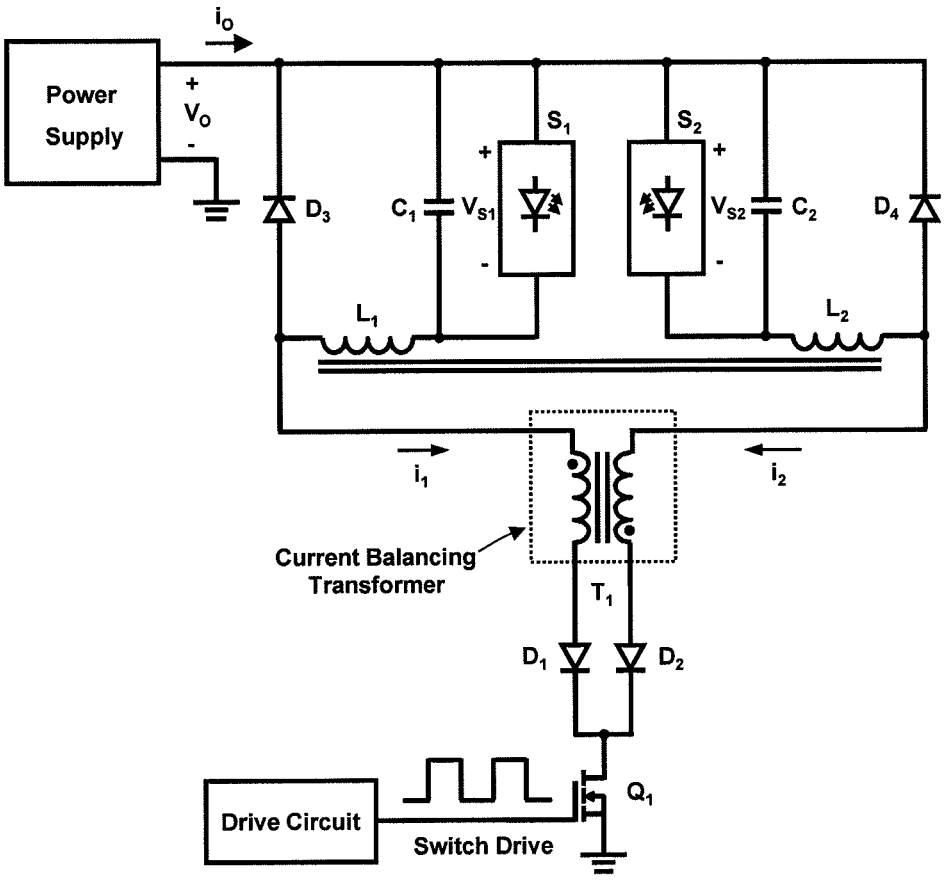
FIG. 17 shows a block diagram of a load current balancing circuit providing continuous current flow with coupled inductors to loads according to an embodiment of present invention.

When control switch $Q_1$ is turned on, current $i_1$ through inductor winding $L_1$ and current $i_2$ through inductor winding $L_2$ ramp up, and magnetic energy is stored in the inductors. At the same time, currents $i_1$ and $i_2$ flow through the primary and secondary windings of transformer $T_1$, respectively. Currents $i_1$ and $i_2$ are equal provided that the magnetizing current of transformer $T_1$ is small compared with the winding current. When $Q_1$ is turned off, diodes $D_3$ and $D_4$ become forward biased and inductor winding currents $i_1$ and $i_2$ continue to flow through $D_3$ and $D_4$, respectively. While the inductor winding current flows, inductor winding currents $i_1$ and $i_2$ decrease with a slope of $V_{S1}/L_1$ and $V_{S2}/L_2$, respectively, and the energy stored in each inductor is released to a respective LED string. The current of each LED string, which is the average of respective inductor winding current, is substantially equal to each other provided that inductances $L_1$ and $L_2$ are equal. FIG. 17 shows a block diagram of a load current balancing circuit providing continuous current flow with coupled inductors to loads according to an embodiment of present invention. Coupling the inductors can reduce the number of inductors, as illustrated in FIG. 17. The embodiments shown in FIGS. 15 to 17 can be easily extended to any number of loads by those skilled in the art.

Figure 18:
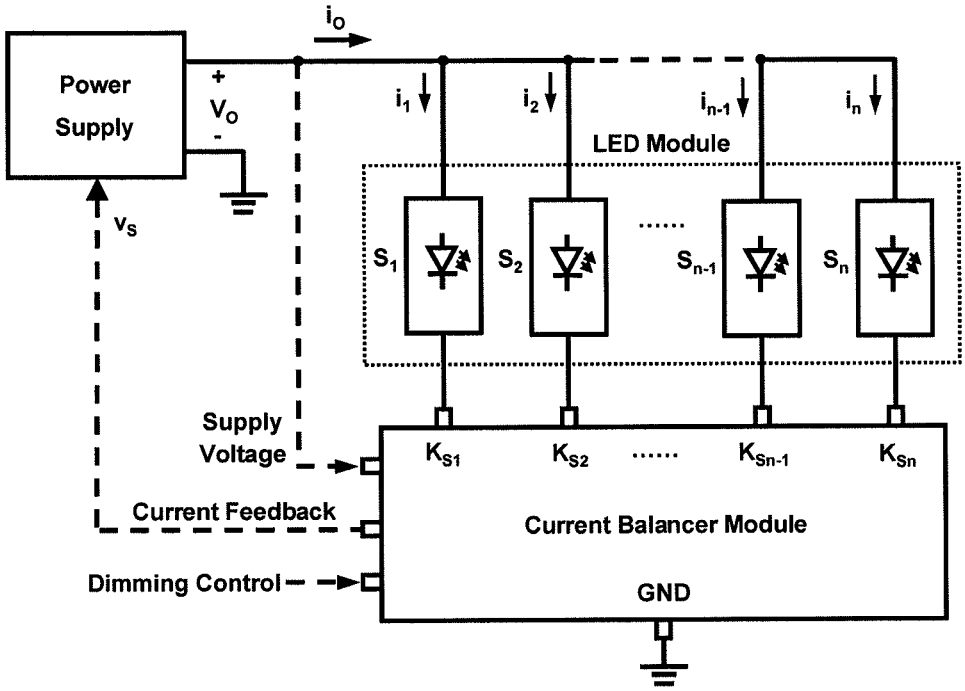
FIG. 18 shows a block diagram of a modular load current balancing circuit according to an embodiment of present invention.

FIG. 18 shows a block diagram of a modular load current balancing circuit according to an embodiment of present invention. Since the load current balancing circuit is not integrated in the power supply and can accommodate various power sources, the current balancing circuit can be designed and built as a current-balancing module. A modular current load balancing circuit makes it possible to modularize a lighting system consisting of LED strings connected in parallel. The block diagram shows an LED lighting system consisting of a power-supply module, LED array module, and current-balancing module. In addition to the terminals to connect the LED strings, the current-balancing module has optional terminals for implementing the current feedback to the power supply, dimming control, and direct connection to the output of the power supply.

The examples and embodiments described herein are non-limiting examples. The invention is described in details with respect to exemplary embodiments, and it will now be apparent from the foregoing to those skilled in the art that changes and modifications may be made without departing from the invention in its broader aspects, and the invention, therefore, as defined in the claims, is intended to cover all such changes and modifications which fall within the true spirit of the invention

The invention claimed is:

1. A load current balancing circuit that operates with a direct current (DC) power supply, comprising:

at least one transformer having a first inductive element adapted to couple in series with a first load and a second inductive element adapted to couple in series with a second load, wherein the first load is parallel to the second load, and at least one switch adapted to operate at one or more switching frequencies associated with at least one driving signal, wherein said switch is configured to periodically interrupt respective current flows through the first inductive element and second inductive element substantially simultaneously.

2. The load current balancing circuit of claim 1, wherein the at least one transformer comprises a primary winding that comprises the first inductive element and a secondary winding that comprises the second inductive element.

3. The load current balancing circuit of claim 1, wherein the at least one transformer comprises a plurality of transformers each having a primary and a secondary winding, wherein the primary winding of one transformer is coupled in series with the secondary winding of another second transformer.

4. The load current balancing circuit of claim 1, wherein the at least one transformer comprises a plurality of transformers each having a primary and a secondary winding, wherein the primary windings of the plurality of transformers are coupled in series.

5. The load current balancing circuit of claim 4, wherein the first inductive element comprises the primary windings of the plurality of transformers.

6. The load current balancing circuit of claim 4, wherein the second inductive element comprises a secondary winding of one of the plurality of the transformers.

7. The load current balancing circuit of claim 4, wherein the primary windings are coupled in series and shorted.

8. The load current balancing circuit of claim 1, wherein the at least one switch comprises a plurality of switches each connected in series with a corresponding inductive element and a corresponding load.

9. The load current balancing circuit of claim 8, wherein the plurality of switches comprises switches that are substantially simultaneously opened and closed.

10. The load current balancing circuit of claim 1, further comprising a current limiting circuit.

11. The load current balancing circuit of claim 10, wherein the current limiting circuit comprises a resistor.

12. The load current balancing circuit of claim 10, wherein a voltage across the current limiting circuit is sensed and used to adjust the output voltage of the DC power supply.

13. The load current balancing circuit of claim 1, further comprising a detector that opens the at least one switch upon detecting a load fault.

14. The load current balancing circuit of claim 1, wherein the at least one driving signal comprises a higher frequency signal modulated by a lower frequency signal.

15. The load current balancing circuit of claim 14, wherein the first load and second load comprise light-emitting diodes (LED) and wherein the lower frequency signal comprises a dimming signal.

16. The load current balancing circuit of claim 14, wherein currents through the first load and second load are adjusted based on at least one of:

adjusting the duty cycle of the higher frequency signal;

adjusting the duty cycle of the lower frequency signal; or adjusting the output of the power supply.

17. The load current balancing circuit of claim 14, wherein the at least one switch comprises a plurality of switches, wherein each of the switches are controlled based on a corresponding driving signal, wherein the corresponding driving signals of the plurality of switches are phase shifted.

18. The load current balancing circuit of claim 1, further comprising a first capacitor connected in parallel with the first load and a second capacitor connected in parallel with the second load, to provide current to the loads when the at least one switch is opened.

19. The load current balancing circuit of claim 1, further comprising a first inductor connected in series with the first load and a second inductor connected in series with the second load, to provide current to the loads when the at least one switch is opened.

20. The load current balancing circuit of claim 1, wherein the first inductor and second inductor are magnetically coupled.

21. The load current balancing circuit of claim 1, wherein the DC power supply comprises voltage from at least one of: a battery, a DC/DC converter, or an AC/DC converter.

22. The load current balancing circuit of claim 1, further comprising a first rectifier diode connected in series with the first load and a second rectifier diode connected in series with the second load, to reduce the equivalent capacitances of the first rectifier diode connected to the first load and the second rectifier diode connected to the second load.

23. The load current balancing circuit of claim 1, wherein the at least one transformer comprises a unity turns ratio transformer.

* * * * *